US006353990B1

(12) United States Patent
Anttila et al.

(10) Patent No.: US 6,353,990 B1
(45) Date of Patent: Mar. 12, 2002

(54) PROCEDURE AND APPARATUS FOR POST-FACING OF ELEVATOR CAR DOOR AND LANDING DOOR

(75) Inventors: Harri Anttila, Jokela; Ari Ketonen, Hyvinkää, both of (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 09/202,499

(22) PCT Filed: Jun. 19, 1997

(86) PCT No.: PCT/FI97/00394

§ 371 Date: Feb. 16, 1999

§ 102(e) Date: Feb. 16, 1999

(87) PCT Pub. No.: WO97/49631

PCT Pub. Date: Dec. 31, 1997

(30) Foreign Application Priority Data

Jun. 26, 1996 (FI) ..... 962647

(51) Int. Cl.[7] ..... B66B 13/30

(52) U.S. Cl. ..... 29/469.5; 49/501; 52/745.15; 52/745.16; 52/792.1; 52/792.11; 52/792.13; 312/265.5; 312/265.6; 29/458

(58) Field of Search ..... 29/458, 469.5; 49/460, 501; 52/745.15, 745.16, 792.1, 792.11, 784.13; 312/263, 265.5, 265.6

(56) References Cited

U.S. PATENT DOCUMENTS

| | | | | | |
|---|---|---|---|---|---|
| 1,728,964 | A | * | 9/1929 | Gross | 52/784.13 |
| 2,797,130 | A | * | 6/1957 | Renno | |
| 3,858,355 | A | * | 1/1975 | Root | |
| 4,398,984 | A | * | 8/1983 | Uchiyama et al. | |
| 4,800,638 | A | * | 1/1989 | Herringshaw et al. | |
| 5,156,237 | A | | 10/1992 | Hayashi et al. | |
| 5,842,545 | A | * | 12/1998 | Blaiotta | |

FOREIGN PATENT DOCUMENTS

| | | | | |
|---|---|---|---|---|
| DE | 337479 | * | 6/1921 | |
| DE | 1134557 | * | 8/1962 | 52/792.11 |
| JP | 53-116648 | | 10/1978 | |
| JP | 03 146 335 | * | 6/1991 | |
| JP | 04 012 985 | * | 1/1992 | |
| JP | 6-247673 | | 9/1994 | |
| JP | 6-312888 | | 11/1994 | |

* cited by examiner

*Primary Examiner*—David P. Bryant
*Assistant Examiner*—Eric Compton
(74) *Attorney, Agent, or Firm*—Birch, Stewart, Kolasch & Birch, LLP

(57) ABSTRACT

The invention relates to a procedure and an apparatus for gluing a facing component (6) designed to be mounted onto the raw door panel (1) of an elevator car or landing to the raw door panel (1). The facing component (6) is fitted into cut-outs (23) in the installed raw door panel (1) by fastenings (11).

22 Claims, 2 Drawing Sheets

PROCEDURE AND APPARATUS FOR POST-FACING OF ELEVATOR CAR DOOR AND LANDING DOOR

This application is the national phase under 35 U.S.C. §371 of prior PCT International Application No. PCT/FI97/00394 which has an International filing date of Jun. 19, 1997 which designated the United States of America.

FIELD OF THE INVENTION

The present invention relates to a procedure and to an apparatus for post-facing of elevator car door and landing door.

DESCRIPTION OF BACKGROUND ART

The structure of existing door panels is such that the door panels must already have a finished surface when they are delivered from factory. The door panel surface is part of the skeletal structure. The door panel is generally covered with a plastic foil to protect it against scratching during transport to the site of installation. In some models, the facing material and the raw door panel are separate parts. In this case, the facing material is attached to the raw door panel at the factory by gluing and using mechanical joints. Door panels are often damaged during transport and installation, so the plastic foil is only removed just before the elevator is taken into use. The commonest forms of damage are scratches and dents in the door panel surface. However, the damage seldom affects the skeletal structure of the raw door panel, but usually its facing. Because of the structure of the door panel, the only way to repair the damages is to deliver a new door panel to the site of installation. This leads to unnecessary expenses and retards the installation work, and the facing material must be selected at an early stage before the doors are fabricated.

SUMMARY OF THE INVENTION

The object of the present invention is to eliminate the drawbacks described above. The procedure of the invention for post-facing of an elevator car door and landing door comprises providing a door panel having a substantially planar forward surface and fastening stoppages disposed proximate to edges of the substantially planar surface; providing a facing component having fastenings and edging along at least one of its edges; providing a coupling agent on at least one of the door panel and the facing component; fitting the fastenings of the facing component to the fastening stoppages of the door panel, the fastenings extending through the substantially planar forward surface of the door panel; engaging the edging of the facing component with an edge of the door panel; and pressing the facing component against the door panel. The apparatus of the invention for post-facing of elevator car door and landing door comprises fastening stoppages disposed proximate edges of a substantially planar forward surface of a door panel; and fastenings proximate a first edge of a facing component, and edging proximate a second edge of the facing component, wherein the fastenings of the facing component are engageable with the fastening stoppages of the door panel, the fastenings extending through the substantially planar forward surface of the door panel when engaged with the fastening stoppages, and an interior surface of the edging is engageable with an exterior surface of the door panel when the facing component is pressed against the door panel.

According to the invention, the skeletal structure of the door panel, i.e. the raw door panel, is made sufficiently rigid and bent into a box-like shape, and it is mounted as such on the overhead supporting beam. The facing material can also be glued to the panel at the factory, but the idea of the invention is that the facing material is glued onto the skeletal structure afterwards without removing the installed raw door panels just before the elevator is taken into use.

Advantages of this structure include: less damage due to bruising; the facing can be mounted just before the elevator is taken into use; no temporary door panels are needed; the skeletal structure is rigid; the facing material can be selected after delivery; it is cost-effective; and the raw panels can be used during the entire installation period.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following, the invention is described in detail by the aid of a few examples of its embodiments by referring to the attached drawings which are given by way of illustration only, and thus are not limitative of the present invention, and in which.

DESCRIPTION OF THE PREFERRED EMBODIMENTS

Figure 1C:
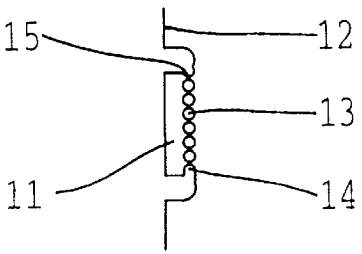
FIGS. 1*a*, 1*b*, 1*c* and 1*d* present a raw door panel, a facing component and attaching parts in the facing component and raw door panel.
Figure 1D:
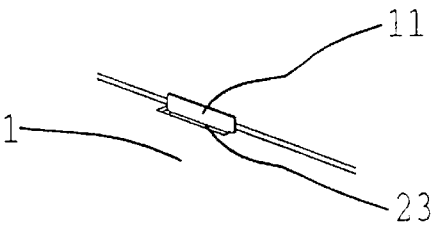
Figure 1A:
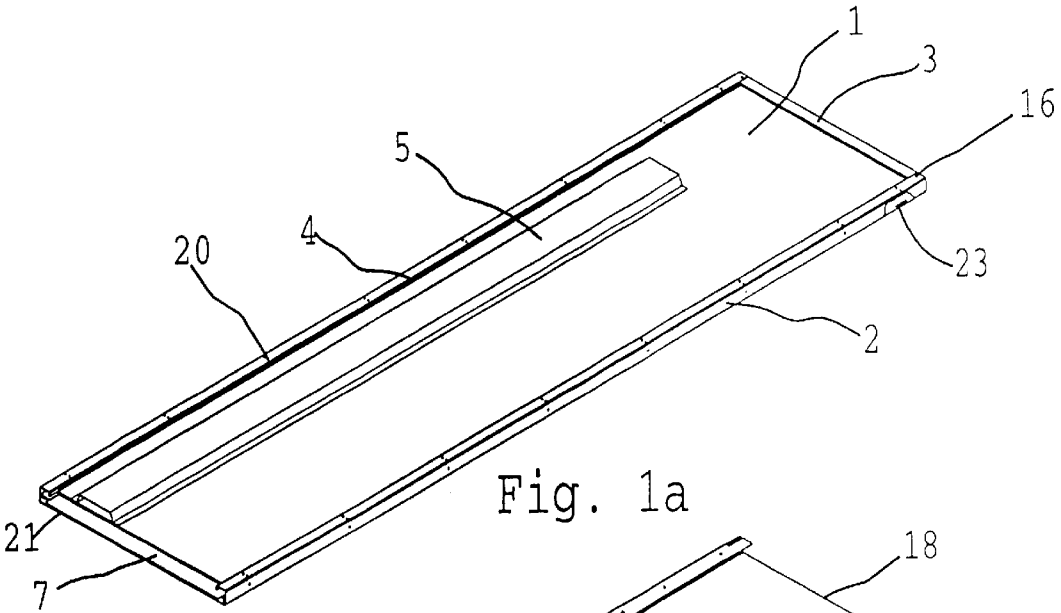

FIG. 1*a* presents a raw door panel 1, whose side edges 2,4 have been bent to form rectangular profiled edgings, which are provided with holes 20. The solution of the invention can also be applied to the car door. The upper end of the raw door panel 1 is also bent into a stiffening edging 3, which is connected to the side edgings 2,4 with screws 16. The raw door panel 1 is also provided with a reinforcement 5 on the side facing towards the elevator shaft. The reinforcement 5 is preferably so placed on the raw door panel 1 that its distance from the edge 4 of the raw door panel 1 is 194 mm and its height is 1720 mm and width 148 mm. The reinforcement 5 is generally made of hot-dip zinc coated steel. The reinforcement 5 is made of steel of the same thickness as the raw door panel 1 itself, i.e. 1.25 mm thick steel. The reinforcement 5 acts as a guide for the closing weight of the raw door panel 1. The edge 2 of the raw door panel 1 is also provided with three cut-outs 23, which are located at the upper and lower ends of the raw door panel edge 2 and at the mid-part of the edge 2, and their size and design may vary as needed. The cut-outs 23 are located in the rear of the raw door panel 1. The edges 3 of the raw door panel 1 lie closely against the frame 17. The dimensions of the raw door panel 1 are preferably so chosen that the facing component 6 can be easily fitted onto the raw door panel 1, and its lower edge 21 is provided with a sliding guide 7.

Figure 1B:
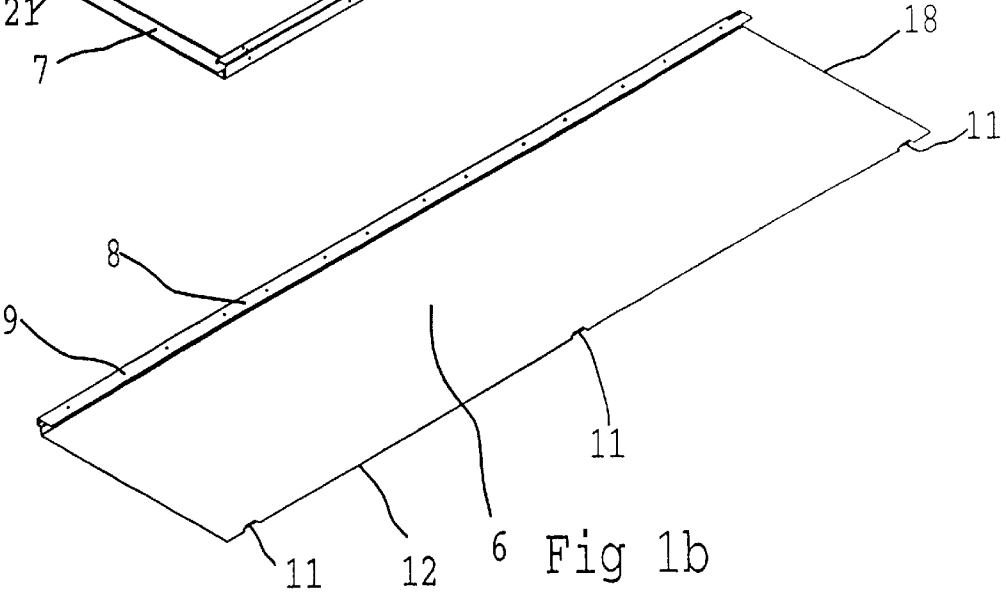

FIG. 1*b* presents a facing component 6. It has an edging 8 made of facing material and provided with holes 9. The edging 8 may be provided with either a fire graded facing or a normal facing. A fire graded facing has proved to be more durable in fire tests and it has prevented the door from buckling. The design of the edging 8 may vary. After the facing component 6 has been mounted, impact battens 10 are attached to this edging 8. The edge 12 of the facing component 6 is provided with fastenings 11, by means of which the facing component 6 is attached to the raw door panel 1. There are as many fastenings 11 as there are cut-outs 23 in the raw door panel 1. The fastening 11 is formed from the edge 12 of the facing component 6 by making a cut in it as illustrated by FIG. 1*c*. The fastening 11 is bent up to a position perpendicular to the facing component 6 and the protecting plastic is removed from it. The facing material used may be 1-mm electrogalvanized sheet steel, stainless steel or brass bent in a channel shape.

FIG. 1*c* shows a fastening 11 used as a mounting element. It is of a rectangular structure and it is partly cut off from the edge 12, with a succession of relief holes 13 for easier bending. At the lower end of the succession of relief holes 13 there is a locking hole 14. This is of a semi-circular form and it serves to lock the facing component 6 to the cut-out 23 in the raw door panel 1. At the upper end of the fastening there is also a smaller notch 15 to allow easier mounting. The fastening 11 could also be implemented as a protruding bracket, but making such brackets would mean more waste material left over, so it would be more expensive.

FIG. 1*d* presents a cut-out 23 acting as a locking element in the raw door panel 1. Mounted in this cut-out 23 is a fastening 11 of the facing component 6. There are three cut-outs 23 in the edge 2 of the raw door panel 1, one cut-out 23 being provided at each end and at the middle of the edge 2. The number of cut-outs varies according to the number of fastenings 11.

FIGS. 2*a*, 2*b*, 2*c*, 2*d* and 2*e* illustrate different phases of the process of mounting a facing component on the raw door panel 1. Both raw door panels 1 are faced in the same way and they are of identical construction. The impact batten 10 attached to the raw door panel 1 is temporarily removed before the gluing. The facing component 6 is attached by gluing to the raw door panel 1 while the latter is in contact with the jamb 17. The glue is applied to that side of the facing component 6 which has no edging 8.

Figure 2A:
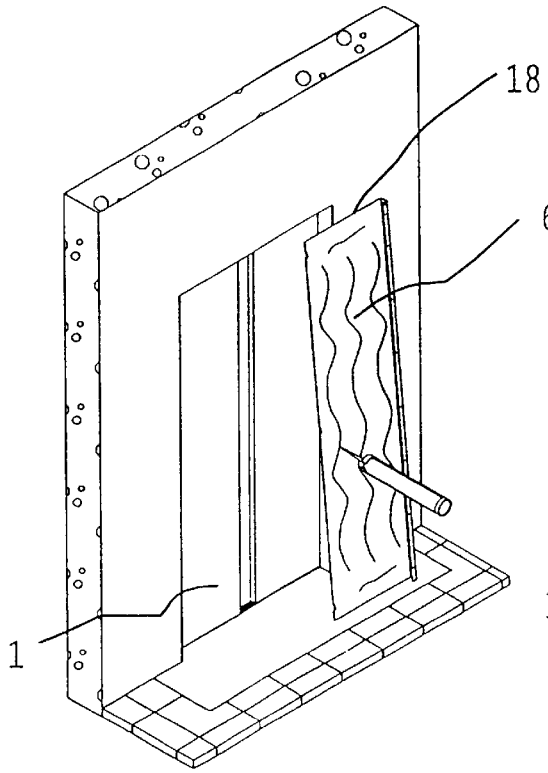
FIGS. 2*a*, 2*b*, 2*c*, 2*d* and 2*e* illustrate various stages of the process of mounting the facing component.
Figure 2B:
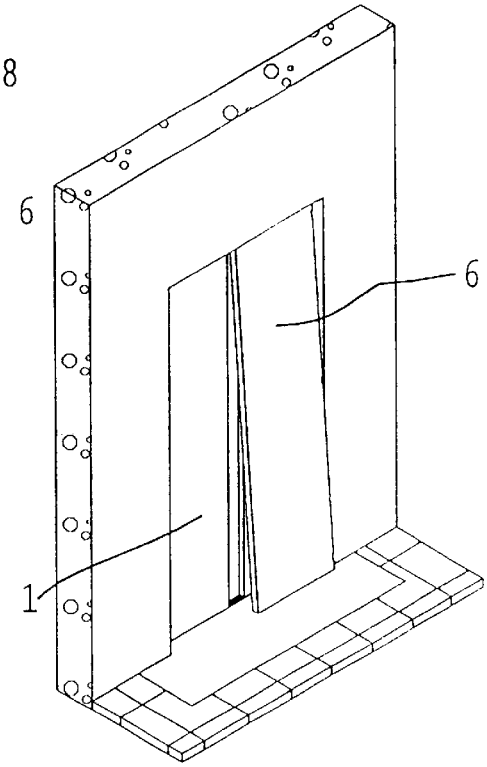

After this, as illustrated by FIG. 2*b*, the facing component 6 is placed onto the raw door panel 1 by inserting its top edge between the head 19 and the raw door panel 1, whereupon the facing component 6 is pressed against the raw door panel 1 so that the fastenings 11 engage the cut-outs 23 in the raw door panel 1, the number of cut-outs corresponding to the number of fastenings 11. The facing component 6 is locked in position by virtue of the locking hole 14 provided in the fastening 11. The facing component 6 is then given a push with the hand to set it properly in position.

Figure 2C:
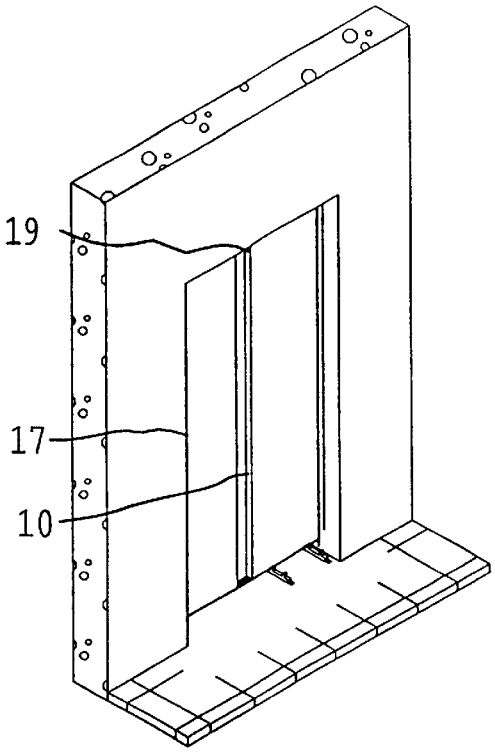

In FIG. 2*c*, the impact batten 10 is fastened to the holes 9 in the edging 8 of the facing component 6. These holes 9 are aligned with the holes 20 in the raw door panel edge 2, so they can also be attached to these holes 20 at the same time. Using a jig, the clearance between the frame post of the faced raw door is checked. The facing component 6 is somewhat wider than the raw door panel 1, so it is easier to mount.

Figure 2D:
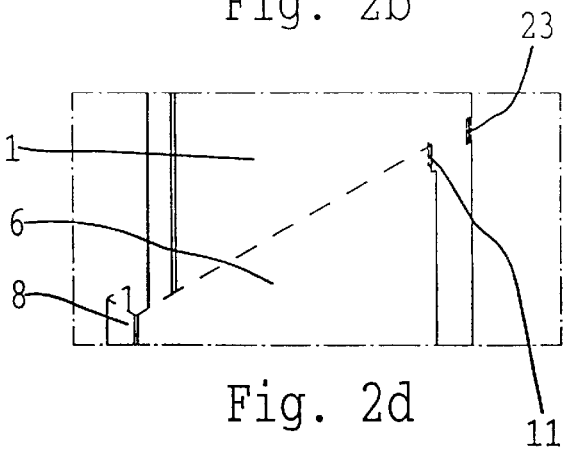

FIG. 2*d* shows a magnified illustration of the fastening 11 engaging the cut-out 23 and edging 8 of the facing component 6 engaging the raw door panel 1.

Figure 2E:
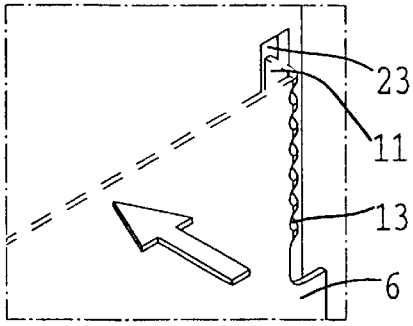

FIG. 2*e* presents a magnified illustration of how the fastening 11 of the facing component 6 is inserted into the cut-out by applying a pressure in the direction indicated by the arrow.

It is obvious to a person skilled in the art that different embodiments of the invention are not restricted to the embodiment described above, but that they can be varied within the scope of the following claims.

What is claimed is:

1. A method for mounting a facing component onto an elevator door panel for an elevator car door or elevator landing door, the method comprising:

providing an elevator door panel having a substantially planar forward surface and fastening stoppages disposed proximate to an edge of the substantially planar surface;

providing a facing component having fastenings and having edging along at least one of said facing component's edges, wherein the fastenings are integral with a body of the facing component;

providing a coupling agent on at least one of the elevator door panel and the facing component;

bending the fastenings of the facing component in a direction toward said fastening stoppages of the elevator door panel;

fitting the fastenings of the facing component to the fastening stoppages of the elevator door panel so that the fastenings extend through the substantially planar forward surface of the elevator door panel and are bent in a direction toward said fastening stoppages of the elevator door panel;

engaging an interior surface the edging of the facing component with an interior surface of the elevator door panel; and pressing the facing component against the elevator door panel.

2. The method of claim 1, wherein the fastenings are joined to a body of the facing component, relief holes being located where the fastenings are joined to the body of the facing component.

3. The method of claim 1, further comprising the step of inserting an upper edge of the facing component between a head of the elevator door and the elevator door panel after the coupling agent is applied.

4. The method of claim 1, wherein the fastening stoppages are cut-outs in the elevator door panel.

5. The method of claim 1, wherein at least one fastening includes a locking recess on an edge of a base of the fastening, the facing component being secured to the elevator door panel by the engagement of the locking recess with one of said fastening stoppages.

6. The method of claim 1, wherein the step of providing a coupling agent includes the step of providing adhesive on at least one of the elevator door panel and the facing component.

7. The method of claim 1, wherein the edging is bent into a box shape on a side of the facing component distal to the fastenings, the step of engaging the edging with the edge of the elevator door panel including the step of engaging an interior of the box shape with an exterior of the elevator door panel.

8. The method according to claim 1, wherein said fitting of the fastenings of the facing component to the fastening stoppages of the elevator panel includes fitting an impact batten in a position between said fastenings and said fastening stoppages.

9. The method according to claim 1, wherein said elevator panel is already installed on said elevator car door or landing door.

10. An elevator door assembly for an elevator car door or elevator landing door, the elevator door assembly comprising:

an elevator door panel having a substantially planar forward surface and fastening stoppages disposed proximate an edge of the substantially planar surface, wherein the door panel has a height and a width, at least the edges along the height and an edge along the width of the door panel being bent into box shapes; and a facing component having fastenings proximate a first edge, and having edging proximate a second edge, wherein the fastenings of the facing component are engageable with the fastening stoppages of the elevator door panel, the fastenings extending through the substantially planar forward surface of the elevator door panel when engaged with the fastening stoppages, and an interior surface of the edging is engageable with an exterior surface of the elevator door panel when the facing component is pressed against the elevator door panel.

11. The elevator door assembly of claim 10, wherein the fastenings are joined to a body of the facing component, relief holes being located where the fastenings are joined to the body of the facing component.

12. The elevator door assembly of claim 10, wherein the fastening stoppages are cut-outs in the elevator door panel.

13. The elevator door assembly of claim 10, wherein at least one fastening includes a locking recess on an edge of a base of the fastening, the facing component being securable to the elevator door panel by the engagement of the locking recess with one of said fastening stoppages.

14. The elevator door assembly of claim 10, wherein the edging of the facing component has a box shape.

15. The elevator door assembly of claim 10, wherein the edge along the width of the elevator door panel being joined to the edges along the height of the elevator door panel by screws.

16. The elevator door assembly of claim 10, wherein the elevator door panel includes a reinforcement for accommodating a closing weight.

17. In a combination of a facing component and an elevator door panel for an elevator car door or landing door, an attachment assembly comprising:

fastening stoppages disposed proximate an edge of a substantially planar forward surface of the elevator door panel; and fastenings proximate a first edge of the facing component, and edging proximate a second edge of the facing component, wherein the fastenings of the facing component are engageable with the fastening stoppages of the elevator door panel and are joined to a body of the facing component, the fastenings extending through the substantially planar forward surface of the elevator door panel when engaged with the fastening stoppages and are bent in a direction toward said fastening stoppages of the elevator door panel, and an interior surface of the edging is engageable with an exterior surface of the elevator door panel when the facing component is pressed against the door panel.

18. The attachment assembly of claim 17, wherein the fastenings are joined to a body of the facing component, relief holes being located where the fastenings are joined to the body of the facing component.

19. The attachment assembly of claim 17, wherein the fastening stoppages are cut-outs in the elevator door panel.

20. The attachment assembly of claim 17, wherein at least one fastening includes a locking recess on an edge of a base of the fastening, the facing component being securable to the door panel by the engagement of the locking recess with one of said fastening stoppages.

21. The attachment assembly of claim 17, wherein the edging of the facing component has a box shape.

22. The attachment assembly of claim 17, wherein the elevator door panel has a height and a width, the edges along the height and an edge along the width of the elevator door panel being bent into box shapes, and the edge along the width of the elevator door panel being joined to the edges along the height of the elevator door panel by screws.

* * * * *